United States Patent [19]

Takimoto et al.

[11] 4,128,089

[45] Dec. 5, 1978

[54] EXHAUST GAS RECIRCULATION APPARATUS FOR AN INTERNAL COMBUSTION ENGINE

[75] Inventors: Masatami Takimoto; Mitsuyoshi Teramura; Masahiro Urushidani, all of Toyota, Japan

[73] Assignee: Toyota Jidosha Kogyo Kabushiki Kaisha, Toyota, Japan

[21] Appl. No.: 781,426

[22] Filed: Mar. 25, 1977

[30] Foreign Application Priority Data

Jan. 6, 1977 [JP] Japan ..... 52-524

[51] Int. Cl.[2] ..... F02M 25/06

[52] U.S. Cl. ..... 123/119 A

[58] Field of Search ..... 123/119 A

[56] References Cited

U.S. PATENT DOCUMENTS 4,033,309 7/1977 Hayashi et al. ..... 123/119 A
4,041,917 8/1977 Suzuki ..... 123/119 A

FOREIGN PATENT DOCUMENTS 2343337 8/1973 Fed. Rep. of Germany ..... 123/119 A
2400029 7/1974 Fed. Rep. of Germany ..... 123/119 A
2400083 7/1974 Fed. Rep. of Germany ..... 123/119 A

*Primary Examiner*—Charles J. Myhre
*Assistant Examiner*—Craig R. Feinberg
*Attorney, Agent, or Firm*—Stevens, Davis, Miller & Mosher

[57] ABSTRACT

An exhaust gas recirculation apparatus for an internal combustion engine, which has a so-called EGR (Exhaust Gas Recirculation) valve provided with a vacuum actuator for controlling the amount of exhaust gas to be recirculated. An air introducing pipe is opened to the intake system for introducing an extra amount of air into the engine. An air control valve is provided on the air introducing pipe for stopping this introduction of the extra amount of air into the engine so that a rich air-fuel mixture can be supplied into the engine when the engine is beginning to accelerate from a low rotational speed. The vacuum actuator of the EGR valve is connected to this air introducing pipe, in order to carry out an EGR operation when a rich combustible mixture is supplied to the engine.

2 Claims, 1 Drawing Figure

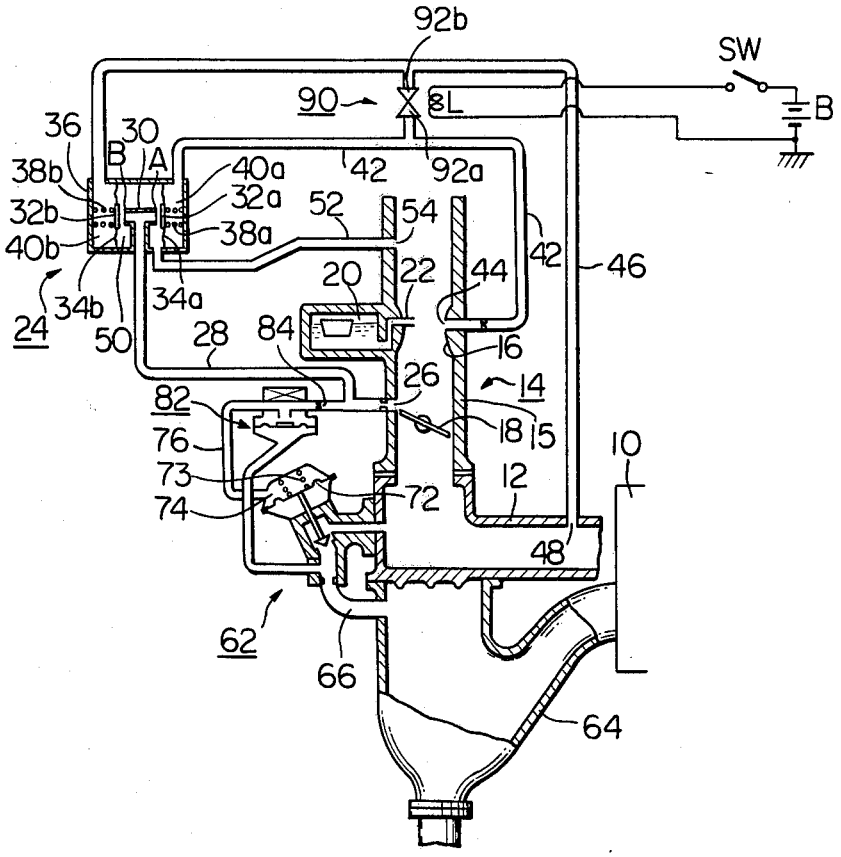
92b
SW
90
8L
B
36
30
B
A
38b
40a
42
92a
32b
32a
52
54
40b
38a
42
46
20
22
44
24
34b
34a
50
28
84
16
26
14
82
18
15
76
10
73
12
74
72
48
62
66
64

EXHAUST GAS RECIRCULATION APPARATUS FOR AN INTERNAL COMBUSTION ENGINE

DESCRIPTION OF THE INVENTION

The present invention relates to an exhaust gas recirculation apparatus for an internal combustion engine.

It is well-known that in order to decrease an amount of the nitrogen oxides ($NO_x$) emission from an internal combustion engine when the engine is beginning to accelerate, a type of exhaust gas recirculating apparatus is used wherein a rich air-fuel mixture is introduced into the engine during the EGR operation. (As disclosed in U.S. patent application Ser. No. 645,392).

An object of the present invention is to provide an exhaust gas recirculation apparatus of the above-mentioned type with a simple construction which is capable of performing a positive EGR operation.

Another object of the present invention is to provide an EGR apparatus of this type which exhibits a high fuel consumption efficiency and a superior drivability in the engine.

Provided according to the present invention is an exhaust gas recirculation apparatus for an internal combustion engine of a carburetor type which includes a vacuum-operated flow control valve for recirculating exhaust gas from the exhaust system of the engine into the intake system of the engine, said apparatus comprising an air introducing passageway means which has one end thereof opened to the intake system of the engine for introducing an extra amount of air into the intake system in order to supply a lean air-fuel mixture into the engine;

an air control valve for closing the other end of the air introducing passageway means for stopping the introduction of an extra amount of air in order to supply a rich air-fuel mixture into the engine, during when the engine is in a running condition wherein both the vacuum level in the venturi portion of the carburetor and the vacuum level in the intake system are all lower than respective predetermined values thereof; and a vacuum signal passageway means adapted for communicating the air introducing pipe means with the vacuum-operated flow control valve, in order to transmit a vacuum signal from the air introducing passageway means to the flow control valve when the air introducing passageway means is closed for the supplying of a rich air-fuel mixture into the engine.

The present invention will now be described with reference to the accompanying drawing which schematically shows one embodiment of the exhaust gas recirculation apparatus according to the invention.

In the drawing showing an embodiment of the present invention, numeral 10 designates the engine body of an internal combustion engine. Connected to the engine body 10 is an intake manifold 12, on which a carburetor 14 is mounted. The carburetor 14 has a barrel 15 defining a venturi portion 16, which is located above a throttle valve 18. The carburetor 14 has a float chamber 20, from which an amount of fuel is directed to the venturi portion 16 via a fuel conduit 22. The fuel is mixed with an amount of air from an air cleaner (not shown) located above the carburetor 14, in order to form a combustible mixture which is supplied to the intake manifold 12.

The engine is provided with an exhaust gas recirculation system of the exhaust gas pressure control type which includes a so-called EGR valve 62 and a pressure modulator valve 82. The EGR valve 62 operates to control the amount of exhaust gas to be recirculated in a passageway (EGR passageway) 66 connecting an exhaust manifold 64 to the intake manifold 12. The EGR valve 62 has a well-known vacuum actuator 74 which includes a spring-urged diaphragm 72. The actuator 74, which is opened to the inside of the carburetor 14 by a vacuum signal tube 76 (as will be fully described later), operates to open and to close the EGR valve 62 in accordance with the vacuum level in the carburetor 14.

The pressure modulating valve 82, which is located on the vacuum signal tube 76, operates to maintain a predetermined constant pressure of the exhaust gas in the EGR passageway 66. Thus, an ideal EGR operation can be carried out as is well-known to those who are skilled in this art.

An air introducing pipe 28, adapted for introducing an extra amount of air into the carburetor 14 to obtain a relatively lean combustible mixture when the EGR valve 62 is in a closed condition, is opened to the carburetor 14 at a port 26 located above the throttle valve 18 which is in its idle position. On one end of the pipe 28, which is remote from the port 26, an air control valve 24 is situated. The air control valve 24 operates to prevent the introduction of an extra amount of air into the engine, in order to supply a relatively rich air-fuel mixture to the engine, when the EGR valve 62 is in an opened condition. The air control valve 24 has a pipe-shaped valve seat 30 which is opened on both ends A and B, and which is connected to one end of the pipe 28. A first valve member **32*a*, fixedly mounted to a first diaphragm 34*a* faces one end of the valve seat 30. A second valve member 32*b*, fixedly mounted to a second diaphragm 34*b*, faces the other end of the valve seat 30. Thus, an air chamber 50 is formed between the first diaphragm 34*a* and the second diaphragm 34*b*. The air chamber 50 is connected, via an air introducing pipe 52, to an air port 54 which is formed in the barrel 15 at a position located above the venturi portion 16. Thus, air from the air cleaner (not shown) can be introduced into the chamber air 50 via the air port 54 and the pipe 52. The air control valve 24 is in its opened condition when the first valve member 32*a* or the second valve member 32*b* is detached from the valve seat 30 at the first end A or at the second end B, respectively. When the air control valve 24 is in the opened position, air in the air chamber 50 is introduced into the barrel 15 via the valve seat 30, the pipe 28 and the port 26, so that a relatively lean air-fuel mixture can be supplied to the intake manifold 12. Whereas, the air control valve 24 is in its closed condition when both the first valve member 32*a* and second valve member 32*b* are rested on the valve seat 30 at the first end A and the second end B, respectively. When the air control valve is in the closed condition, air in the air chamber 50 is not directed to the pipe 28, so that a relatively rich air-fuel mixture is supplied to the intake manifold 12 from the carburetor 14**.

As will be described later, the air control valve 24 is in its closed condition when the engine is operating under a condition wherein the vacuum level in the venturi portion 16 as well as the vacuum level in the intake manifold are low, such a condition occurring when the engine is beginning to accelerate.

A first vacuum chamber **40*a* is formed on one side of the first diaphragm 34*a* which is located remote from the valve seat 30. In the chamber 40*a*, a spring 38*a* is arranged, which urges the first valve member 32*a* toward the valve seat 30. The chamber 40*a* is opened, via a vacuum signal pipe 42, to a first vacuum port 44 formed in the venturi portion 16. Thus, a venturi vacuum force is applied to the first diaphragm 34***a* against the force of the spring 38*a*. The vacuum level at the first port 44 is proportional to the amount of intake air passed through the venturi portion 16. Therefore, when the amount of intake air is large and when the vacuum level at the port 44 is high, the valve member 32*a* is detached, against the force of the spring 38*a*, from the valve seat 30 at the end A. Whereas, when the amount of intake air is small and when the venturi vacuum is low, the first valve member 32*a* is rested on the valve seat 30 at the first end A thereof.

A second vacuum chamber 40*b* is formed on one side of the second diaphragm 34*b* located remote from the valve seat 30. A spring 38*b* arranged in the second vacuum chamber 40*b* urges the second valve member 32*b* toward the valve seat 30. The second vacuum chamber 40*b* is opened, via a vacuum signal pipe 46, to a second vacuum port 48 formed in the intake manifold 12 which is located downstream of the throttle valve 18. Thus, a vacuum force is applied to the second diaphragm 34*b* against the force of the spring 38*b*. The vacuum level at the second port 48 is reversely proportional to the opening of the throttle valve 18. Therefore, the throttle opening is small. When the vacuum level at the port 48 is high, the valve member 32*b* is detached, against the force of spring 38*b*, from the valve seat at the end B. Whereas, when the throttle opening is large and when the vacuum level at the port 48 is low, the valve member 32*b* is rested on the valve seat at the second end B thereof. It should be noted that vacuum level at the second port 48 is always higher than the minimum vacuum level at the first port 44.

As is clear from the above description, the air control valve 24 is in its opened condition when either the venturi vacuum or the manifold vacuum is very high, so that an extra amount of air can be introduced into the engine, thereby causing a lean combustible mixture to be supplied to the engine. On the other hand, the air control valve 24 is in its closed condition when the engine is operating under a condition wherein both the venturi vacuum and the manifold vacuum are low, such condition occurring when the engine begins to accelerate. This is because, in this condition the throttle opening is very large (which causes a small manifold vacuum to occur) and the engine rotational speed is still small (which causes a small venturi vacuum to occur).

According to the present invention, the one of the vacuum signal tube 76 which is remote from the side of the vacuum actuator 74 is opened to the air introducing pipe 28, in order to operate the EGR valve 62 in accordance with the pressure in the air introducing pipe 28. An orifice 84 of a very small dimension is formed in the vacuum signal pipe 76 for controlling the level of the vacuum in the vacuum actuator 74.

When the air introducing pipe 28 is opened to the atmosphere due to the opened position of the air control valve 24 for supplying a lean air-fuel mixture into the engine, the pressure in the vacuum actuator 74 becomes atmospheric and causes the EGR valve 62 to be closed, thereby preventing an EGR operation from occurring. Whereas, when the air introducing pipe 28 is closed due to the closed position of the air control valve 24 for supplying a rich air-fuel mixture into the engine, the pressure in the vacuum actuator 74 becomes negative if the throttle valve 18 is opened to cause the valve 18 to be located upstream of the port 26. Thus, the EGR valve 62 is opened for carrying out an EGR operation.

According to the present invention, a supplementary control valve 90 is provided for stopping the EGR operation together with the introduction of rich air, when the engine is operating under a condition of a high rotational speed in which a high fuel consumption efficiency and a superior drivability of the engine are required rather than the decreasing of the amount of the $NO_x$ components. The supplementary control valve 90 is an electromagnetic valve having two ports 92*a* and 92*b*, and a solenoid L. The port 92*a* communicates with the venturi vacuum signal pipe 42, whereas the port 92*b* communicates with the manifold vacuum signal pipe 46. The supplementary control valve 90 has a first position in which the ports 92*a* and 92*b* are disconnected from each other when the solenoid L is not energized, and a second position in which the ports 92*a* and 92*b* are connected to each other when the solenoid L is energized. In this second position, the venturi vacuum signal pipe 42 and the manifold vacuum signal pipe 46 are connected to each other, thus the first and second vacuum chambers 40*a* and 40*b* of the air control valve 24 are also connected to each other. Since the force of the spring 38*a* is so determined that it is lower than the minimum manifold vacuum level formed in the second vacuum port 48, the first diaphragm 34*a* is always detached from the valve seat 30 for opening the air control valve 24 when the supplementary control valve 90 is in its second position for stopping the EGR operation.

To energize the solenoid L, the solenoid is connected to a battery B via an EGR control switch SW which detects an engine high-speed condition wherein an EGR operation should not be carried out. For the EGR control switch SW, a so-called transmission gear switch can be utilized. This switch is switched to its ON position to energize the solenoid L when the transmission gear of the engine is in its high-speed range. For the EGR switch SW, a so-called engine speed sensor can also be utilized, which is switched to its ON position when the rotational speed fo the engine is higher than a predetermined value.

In the use of the above-mentioned EGR apparatus according to the present invention, when the throttle valve 18 is fully opened during the beginning of the acceleration of the engine from a low rotational speed, both the venturi vacuum and the manifold vacuum are low enough to maintain the air control valve 24 in its closed position by which the first and second valve members 32*a* and 32*b* are rested on the valve seat 30 at the two ends A and B, respectively, for supplying a rich air-fuel mixture to the engine (as is already described above). Due to the fact that the air control valve 24 is closed the air introducing pipe 28 is under the influence of a negative pressure which is formed downstream of the throttle valve 18. Thus, the vacuum actuator 74, which is connected to the air introducing pipe 28 via the vacuum signal tube 76, is also under the influence of a negative pressure, which pressure causes the EGR valve to be opened for recirculating the exhaust gas in the exhaust manifold 64 to the intake manifold 12 via the EGR passageway 66. Thereby, the amount of the $NO_x$ emission occurring during acceleration of the engine can be effectively decreased.

When the amount of $NO_x$ emission from the engine is small because the engine is operating under a condition other than acceleration from a low rotational speed, the venturi vacuum or the manifold vacuum becomes low enough to open the air control valve 24 for supplying a lean air-fuel mixture to the engine (as is already described above). Due to the fact that the air control valve 24 is opened, the air introducing pipe 28 is under the influence of an atmospheric pressure. Therefore, the vacuum actuator 74 is also under the influence of an atmospheric pressure which pressure causes the EGR valve 62 to be closed thus stopping the EGR operation. Thereby, the fuel consumption efficiency as well as the drivability of the engine are greatly improved.

When the EGR operation is not required due to the transmission gear being shifted to the top speed range, or due to the rotational speed of the engine becoming very high, the EGR control switch SW is closed to energize the solenoid L. Thus, the valve which was previously in the first position, is now switched to the second position wherein the venturi vacuum signal pipe 42 and the manifold vacuum signal pipe 46 are connected to each other. Since the force of the spring 38*a* is so determined that it is smaller than the minimum value of the manifold vacuum, the valve 24 will always remain opened.

While only one embodiment has been described with reference to the accompanying drawing, many modifications and changes can be made thereto by those who are skilled in this art without departing from the spirit and the scope of the present invention.

What is claimed is:

1. In an internal combustion engine including an intake system comprising a carburetor having a venturi portion, an exhaust system and a vacuum operated valve for controlling flow of exhaust gas from said exhaust system to said intake system, the improvement that comprises:

an air introducing pipe means which has one end thereof opened to said intake system of said engine for introducing an extra amount of air into said intake system in order to supply a lean air-fuel mixture into said engine;

an air control valve for closing the other end of said air introducing pipe means for stopping the introduction of an extra amount of air in order to supply a rich air-fuel mixture into said engine, when said engine is in a running condition that both the vacuum level in the venturi portion of the carburetor and the vacuum level in said intake system are lower than respective predetermined values thereof, and;

a vacuum signal passageway means adapted for communicating said air introducing pipe means with said vacuum operated flow control valve, so that a vacuum signal from said air introducing pipe means is received by said flow control valve when said air introducing pipe means is closed for supplying a rich air-fuel mixture into said engine.

2. An exhaust gas recirculation apparatus according to claim 1, wherein said air control valve comprises: a pipe member connected to said other end of said air introducing pipe means and openable to the atmosphere at both ends; a first spring-urged diaphragm facing one end of said pipe member so that a first vacuum chamber, connected to a first vacuum signal port in the venturi portion, is formed on one side of said diaphragm, said first diaphragm being, by the spring force thereof, rested on said one end of said pipe member when the vacuum level at said first vacuum signal port is lower than the first predetermined value; and a second spring-urged diaphragm facing the other end of said pipe member so that a second vacuum chamber, connected to a second vacuum signal port in the intake system, is formed on one side of said second spring-urged diaphragm, the second diaphragm being, by the spring force thereof, rested on said other end of said pipe member when the vacuum level at said second vacuum signal port is lower than a second predetermined value, the spring force of said first diaphragm being so selected that the force is lower than a minimum value of the vacuum level in said second vacuum signal port, and wherein said apparatus further comprises a supplementary control valve for connecting said first and second vacuum chambers with each other so that said first spring-urged diaphragm is, detached from the one end of said pipe member by vacuum pressure at said second vacuum signal port to open said air introducing pipe means to supply a lean air-fuel mixture into said engine, when said engine is operating under another running condition in which recirculation of the exhaust gas is not necessary.

* * * * *